United States Patent [19]

Andeweg

[11] Patent Number: 4,882,865

[45] Date of Patent: Nov. 28, 1989

[54] LIGHT-ANIMATED GRAPHICS DISPLAY

[76] Inventor: Frits J. Andeweg, 7737 Royal La., Dallas, Tex. 75230

[21] Appl. No.: 146,390

[22] Filed: Jan. 21, 1988

[51] Int. Cl.[4] ..... G09F 13/00

[52] U.S. Cl. ..... 40/442; 40/551

[58] Field of Search ..... 40/442, 586, 540, 124.1, 40/152.2

[56] References Cited

U.S. PATENT DOCUMENTS

| | | | |
|---|---|---|---|
| 2,139,281 | 12/1938 | Oliveri | 40/442 |
| 4,034,494 | 7/1977 | Lane | 40/442 |
| 4,055,014 | 10/1977 | Schmidt et al. | 40/442 |
| 4,283,797 | 8/1981 | Sieder | 40/586 |
| 4,286,399 | 9/1981 | Funahashi | 40/442 |
| 4,466,136 | 8/1984 | Bottom et al. | 40/586 |

*Primary Examiner*—Gene Mancene
*Assistant Examiner*—Wenceslao J. Contreras
*Attorney, Agent, or Firm*—Kenneth R. Glaser

[57] ABSTRACT

Disclosed is a graphics display system having a plurality of discrete light sources disposed along, and forming an integral part of, an illustration which is printed upon a shirt or other substrate. A battery-powered pre-programmed timing control circuit selectively illuminates the light sources disclosed as light-emitting diodes extending through openings in the shirt, to produce animation of the illustration and in particular motion of an item from one location on the illustration to a spaced location thereof.

2 Claims, 2 Drawing Sheets

FIG. 1
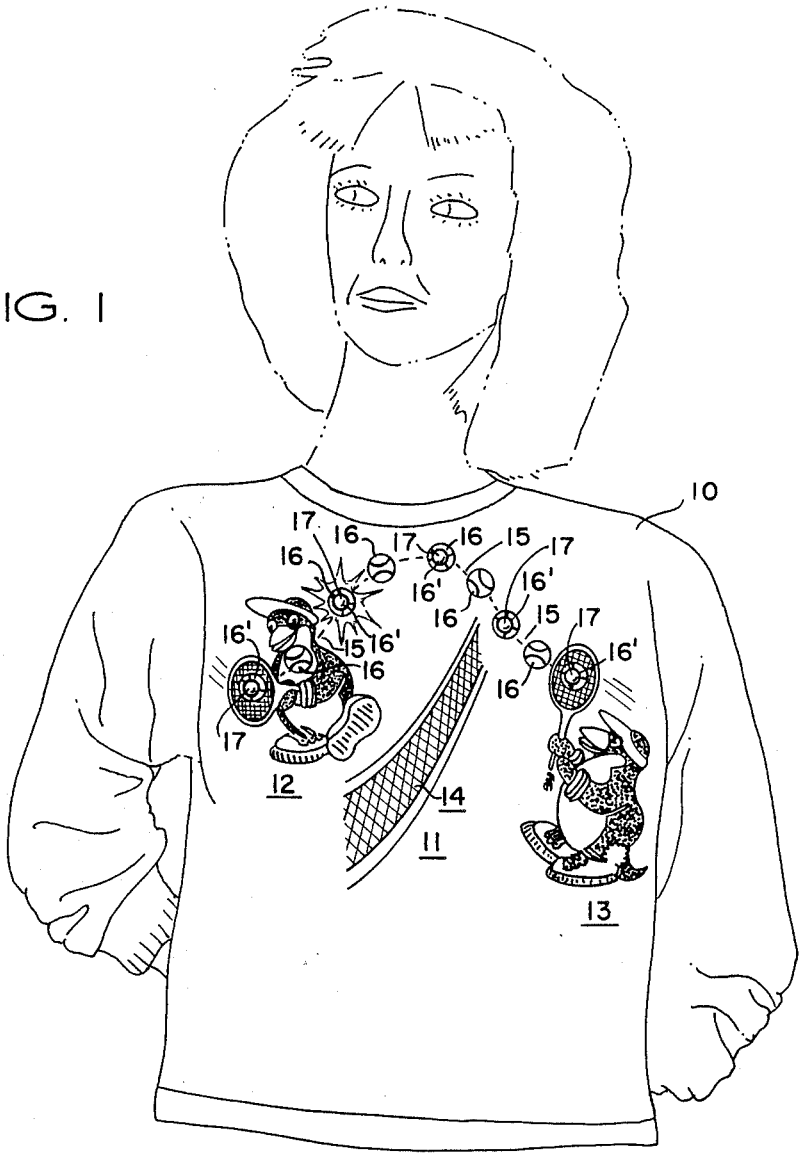
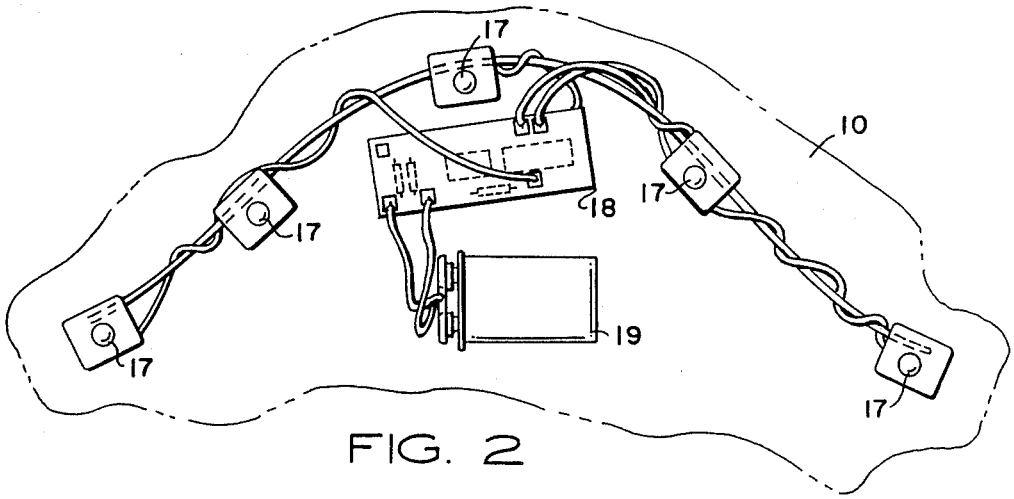
FIG. 2

LIGHT-ANIMATED GRAPHICS DISPLAY

This invention broadly relates to graphics display systems, more particularly to graphics displays incorporating animation, and even more particularly to an improved form of animated graphics display incorporating light movement as the source of the animation.

Animation, and the ability to provide interesting animated displays, have always been in great demand for a wide variety of applications. For example, in the field of point-of-sale displays, animation attracts the attention of the viewers, thus enhancing the advertising benefit of such display. In addition, animation has always contributed to the appeal, and hence the sales, of novelty items.

Accordingly, it is a principal object of the present invention to provide a new and improved type of graphics display.

It is another object of the present invention to provide a new and improved form of animated graphics display.

It is another object of the invention to provide a new and improved method and apparatus for utilizing light to provide animation for graphics illustrations, particularly one that is conducive to portability.

In accordance with these and other objects, the present invention is broadly directed to a graphics display system in which a composite illustration printed or otherwise disposed upon a substrate is animated with the use of discrete light sources disposed along, and forming an integral part of, the composite illustration. The discrete light sources are selectively and alternately illuminated to create the illusion of motion proceeding along such illustration from one location toward a spaced location thereof. In accordance with one particular feature of the invention, the graphics display system is utilized to animate a composite illustration disposed on the face of clothing, the system utilizing control electronics activated by a low-voltage battery, thus enhancing portability.

For a more complete understanding of the invention, as well as further objects, advantages and features thereof, reference may now be had to the following detailed description taken in conjunction with the accompanying drawings, in which:

FIG. 1 illustrates the use of the present invention for the light-animation of a graphic display on the front of a shirt;

FIG. 2 is an illustration of a portion of the reverse side of the shirt depicted in FIG. 1 illustrating the component parts of the electronic assembly for actuating the graphics display system of the invention;

Figure 3:
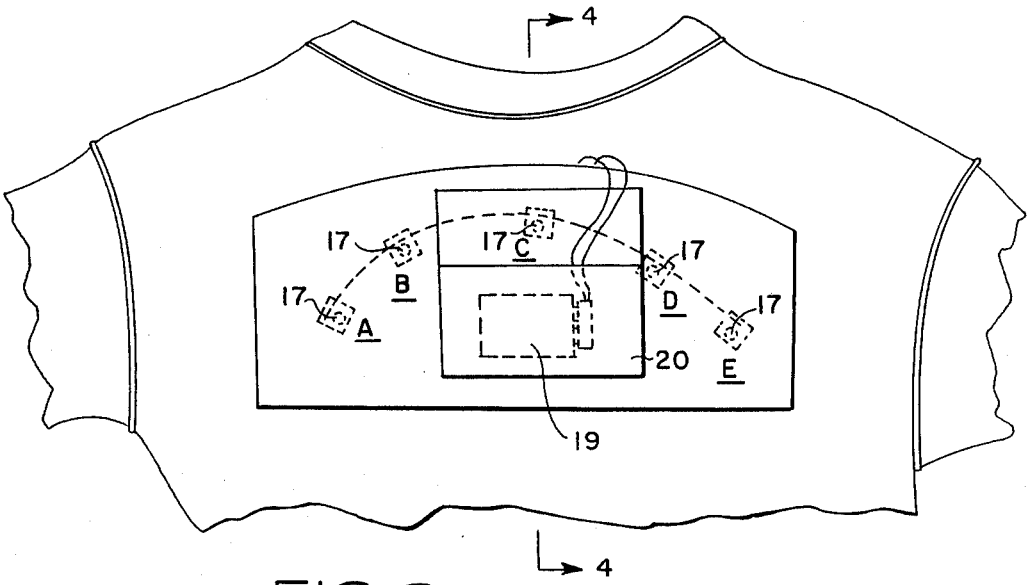
FIG. 3 is a front view of a portion of the shirt shown in FIG. 1, illustrating the light assembly shown in dashed lines.

Referring now to FIG. 1, a conventional blouse or T-shirt 10 is depicted having disposed on the front thereof a composite pattern or illustration 11. In this particular embodiment, the composite illustration comprises a cartoon-like depiction of two penguin tennis players respectively disposed at spaced locations 12 and 13 of the composite illustration 11. A graphic representation of a net is disposed at an intermediate location 14 between the laterally spaced locations 12 and 13. A plurality 16 of tennis balls are pictured along a "flight path" 15 and form a part of the overall or composite illustration.

In accordance with a unique aspect of the present invention, a plurality of discrete light sources 17 are disposed along, and extend through, the composite illustration at respectively different locations 16' which, in this instance, are alternate tennis ball depictions. In the manner subsequently described in greater detail, the array of light sources are sequentially illuminated (and then extinguished) by appropriate timing control circuitry, thereby creating the illusion, in this particular instance, of a tennis ball moving back and forth along the flight path 15 between the tennis rackets of the players disposed at the spaced locations 12 and 13.

Various types of means known in the art may be utilized for the light sources 17, for example l.e.d.'s (light-emitting diodes), incandescent lamps, etc.; but in the particular embodiment depicted in FIG. 1, and of particular utility when the lights are powered by a portable battery operated source, such light sources would preferentially be light-emitting diodes in the form of bulbs extending through apertures in the T-shirt at the various locations 16'.

In accordance with a specific feature of the invention, the array of light-emitting diodes 17 are sequentially turned on and off by pre-programmed timing control circuitry disposed on a conventional circuit board 18 and powered from a low-voltage power source such as a 9-volt battery 19. The pre-programmed control circuitry for effecting the sequential illumination of the bulbs 17 can be of any type conventionally known in the art, for example a solid state timing circuit comprising an oscillator driven counter for generating the appropriately timed pulses to each of the bulbs 17.

Figure 4:
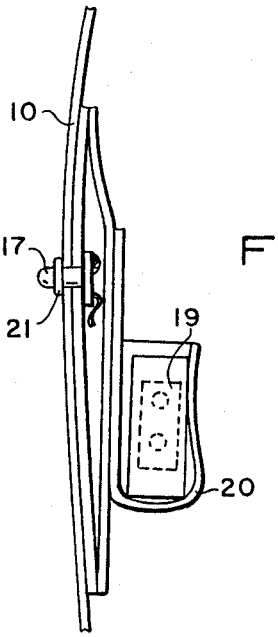
FIG. 4 is a cross sectional view of the shirt and attached assembly, taken along section lines 4—4 of FIG. 3.

As illustrated in FIGS. 3 and 4, a sewn cloth pocket assembly 20 may be provided at the inside of the shirt 10 for conveniently retaining the battery 19, each of the light-emitting diodes (or other type bulbs) preferably extending through openings in the front of the shirt 10 at the desired locations, and maintained in place by rubber grommets 21.

In use, the battery 19 is connected to the control circuitry on the circuit board 18, thus activating the preprogrammed timing circuit and causing the sequential illumination of each of the light sources 17. This is best illustrated in FIG. 3 where the lights, for example, may be illuminated in the sequence A, B, C, D, and E followed by the reverse sequencing of the lights, namely E, D, C, B, and A. It is to be understood, therefore, that in the forward mode, first the light at A is illuminated, then it is extinguished as the light at B is illuminated, etc.

As a consequence, and with reference now to the front of the shirt illustrated in FIG. 1, this light sequencing creates the illusion of back and forth movement of the tennis ball between the players (rackets) at the spaced locations 12 and 13. Furthermore, since the individual light sources 17 extend through the "tennis ball" illustrations (at location 16'), even when the sources are not illuminated, they are part of the overall graphic illustration. Then, when sequentially illuminated, they animate the composite illustration 11.

Figure 5:
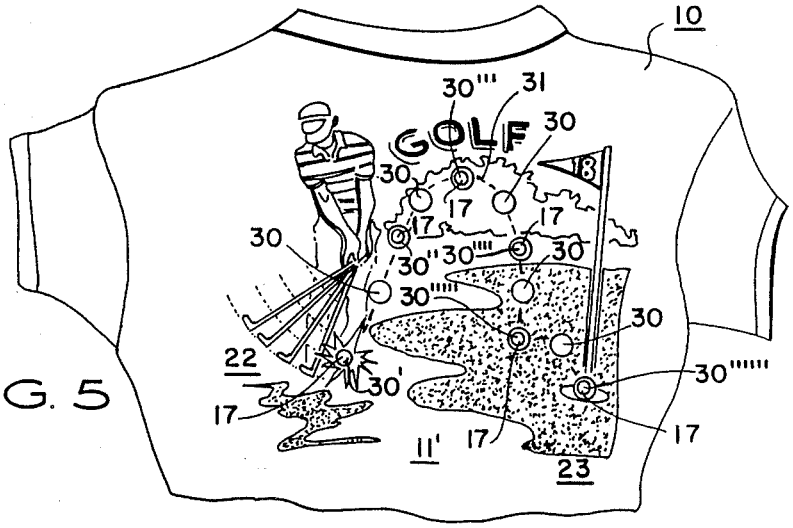
FIG. 5 illustrates another example of the use of the light-animated graphics display system of the present invention.

FIG. 5 depicts another example of the light-animated graphics display of the present invention. In this instance, the composite pattern (indicated as 11') is a golfing scene illustrating a golfer at location 22 chipping onto the green and toward the hole located at spaced location 23. Similar to that described with respect to FIG. 1, the "flight" of the golf ball is graphically presented by depictions 30 of golf balls disposed along a flight path 31, with the light sources 17 extending through such pattern at the selected locations 30', 30'', 30''', etc. Thus, by utilizing pre-programmed control circuitry to sequentially illuminate and extinguish the light sources 17 (in the sequential pattern 30', 30'', 30''', 30'''', 30'''''), an animated illusion is created of the golf ball moving along the flight path from the location 22 towards the location 23.

The patterns illustrated in FIGS. 1 and 5 are only two examples of preferred embodiments of the present invention. Furthermore, there are many variations of the preferred embodiments which may be advantageously employed. For example, while the graphic illustration has been depicted for use upon a T-shirt; any type of substrate for the illustration may be used, such as ice buckets, other items of clothing such as hats or headbands, or a myriad of types of products which can be enhanced by a light-animated graphic display. Furthermore, while the disclosed embodiments of the invention have the light sources extending through selected portions of the composite pattern, it is also contemplated that the light sources can be mounted behind the pattern in a manner which enables back-lighting animation of the imprinted graphics.

Various other modifications to, as well as alternate embodiments of, the present invention may become apparent to one skilled in the art without departing from the scope and spirit of the invention as defined by the appended claims.

What is claimed is:

1. In combination, a shirt and a light-animated graphics display system associated with said shirt, said graphics display system comprising:

(a) a graphic illustration disposed upon an outer face of said shirt;

(b) discrete light sources comprising light-emitting diodes disposed along, and forming an integral part of, said graphic illustration, said diodes extending through openings in said shirt at selected locations along said illustration;

(c) pre-programmed timing circuit control means disposed at the interior surface of said shirt for sequentially illuminating said diodes in a manner which creates the illusion of movement from one location on said illustration toward a second spaced location on said illustration; and (d) portable battery means for powering said timing circuit control means, said battery means being retained in a pocket fixed to said interior surface of said shirt.

2. In combination, a shirt and a light-animated graphics display system associated with said shirt, said graphics display system comprising:

(a) a graphic illustration disposed upon an outer face of said shirt;

(b) discrete light sources disposed along, and forming an integral part of, said graphic illustration, said discrete light sources extending through openings in the face of said shirt at selected locations along said illustration and being retained with respect to said openings by grommets fixed to said shirt;

(c) pre-programmed timing circuit control means disposed at said inside surface for sequentially illuminating said light sources in a manner which creates the illusion of movement from one location on said illustration toward a second spaced location on said illustration; and (d) portable battery means for powering said control means.

* * * * *

UNITED STATES PATENT AND TRADEMARK OFFICE

CERTIFICATE OF CORRECTION

PATENT NO. : 4,882,865

DATED : November 28, 1989

INVENTOR(S) : Frits J. Andeweg

It is certified that error appears in the above-identified patent and that said Letters Patent is hereby corrected as shown below:

Add the following claims:

3. In combination, an article of clothing and a light-animated graphics display system associated with said article of clothing, said graphics display system comprising:

(a) a graphic illustration disposed upon an outer face of said article of clothing;

(b) discrete light sources comprising light-emitting diodes disposed along, and forming an integral part of, said graphic illustration, said diodes extending through openings in said article of clothing at selected locations along said illustration;

(c) pre-programmed timing circuit control means disposed at the interior surface of said article of clothing for sequentially illuminating said diodes in a manner which creates the illusion of movement from one location on said illustration toward a second spaced location on said illustration; and (d) portable battery means for powering said timing circuit control means, said battery means being retained in a pocket fixed to said interior surface of said article of clothing.

4. In combination, an article of clothing and a light-animated graphics display system associated with said article of clothing, said graphics display system comprising:

(a) a graphic illustration disposed upon an outer face of said article of clothing;

(b) discrete light sources disposed along, and forming an integral part of, said graphic illustration,

UNITED STATES PATENT AND TRADEMARK OFFICE

CERTIFICATE OF CORRECTION

PATENT NO. : 4,882,865

DATED : November 28, 1989

INVENTOR(S) : Frits J. Andeweg

It is certified that error appears in the above-identified patent and that said Letters Patent is hereby corrected as shown below:

said discrete light sources extending through openings in the face of said article of clothing at selected locations along said illustration and being retained with respect to said openings by grommets fixed to said article of clothing;

(c) pre-programmed timing circuit control means disposed at said inside surface for sequentially illuminating said light source in a manner which creates the illusion of movement from one location on said illustration toward a second spaced location on said illustration; and (d) portable battery means for powering said control means.

Title page, "2 Claims, 2 Drawing Sheets" should read --4 Claims, 2 Drawing Sheets--.

Signed and Sealed this

Sixteenth Day of October, 1990

*Attest:*

HARRY F. MANBECK, JR.

*Attesting Officer*

*Commissioner of Patents and Trademarks*